United States Patent [19]

Standal

[11] 4,078,592

[45] Mar. 14, 1978

[54] LOG FEED MECHANISM FOR SAWMILLS

[76] Inventor: George M. Standal, 317 Chemainus Rd., R.R. 2, Ladysmith, Bristish Columbia, Canada V0R 2E0

[21] Appl. No.: 752,298

[22] Filed: Dec. 20, 1976

[51] Int. Cl.[2] ..... B27L 1/00

[52] U.S. Cl. ..... 144/208 R; 83/418; 144/3 R; 144/2 AA; 144/39; 144/114 R; 114/117 $; 144/242 R; 144/242 H; 144/246 R; 144/246 F; 144/247; 198/782; 198/862

[58] Field of Search ..... 198/774, 628, 782, 862; 144/242 G, 2 R, 2 AA, 1 R, 39, 41, 114 R, 117 R, 162 R, 172, 242 R, 242 C, 242 D, 242 H, 246 R, 246 C, 246 D, 246 E, 246 F, 247, 162 A; 83/418, 422, 436, 437

[56] References Cited

U.S. PATENT DOCUMENTS

| | | | |
|---|---|---|---|
| 2,748,814 | 6/1956 | Nunn | 144/39 |
| 3,141,482 | 7/1964 | Arness | 144/39 |
| 3,344,826 | 10/1967 | Mitten | 144/3 R |
| 3,457,974 | 7/1969 | Mitten | 144/3 R |
| 3,647,046 | 3/1972 | Tanquay et al. | 198/782 X |
| 3,666,086 | 5/1972 | Brockmann | 198/774 |
| 3,844,399 | 10/1974 | Sellers, Jr. et al. | 144/246 E |
| 3,920,058 | 11/1975 | Walker | 144/39 X |

*Primary Examiner*—Harrison L. Hinson
*Assistant Examiner*—W. D. Bray
*Attorney, Agent, or Firm*—Wells, St. John & Roberts

[57] ABSTRACT

A log feed mechanism that will longitudinally move successive logs toward the cutting and/or chipping mechanisms of a sawmill while holding the successive logs along a prescribed path of movement such that the successive logs may be efficiently sawed into standard size lumber. The feed mechanism includes a roller device by which the successive logs may be rotated about their longitudinal center axes in order to determine the most desirable position for the log to be in when cut into lumber. The successive logs are fed onto a first conveyor assembly that performs the functions of centering the successive logs and moving the logs in a forward direction while maintaining the centered condition. Press rolls are provided over the first conveyor on either side of a rosser. The rosser operates to remove knots and enlarged butts of successive logs to provide a relatively smooth surface for gripping by a downstream second conveyor. The second conveyor receives the logs from the first conveyor after being operated upon by the rosser. It is spiked to firmly grip the smooth surface formed by the rosser and will thereby firmly hold the logs against rotational or lateral movement. To further assist the function of the second conveyor to hold the successive logs against undesirable movement, a number of side roller assemblies are provided that are biased against the logs as they move along the second conveyor. The feed mechanism is mounted on a vertically movable framework that may be selectively adjusted up or down to control the elevational input of the logs moving from the feed mechanism to downstream sawing and/or chipping mechanisms of the sawmill.

11 Claims, 7 Drawing Figures

FIG. 3
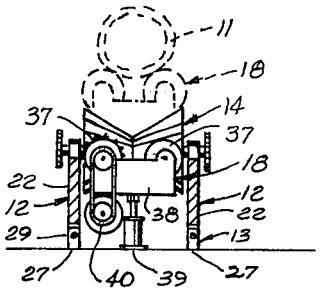
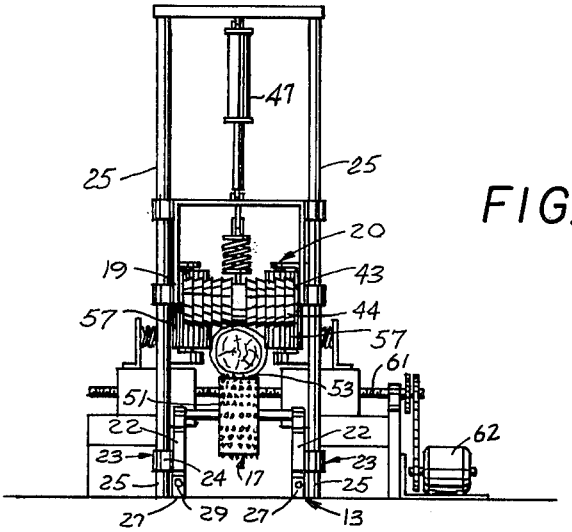
FIG. 4
FIG. 5
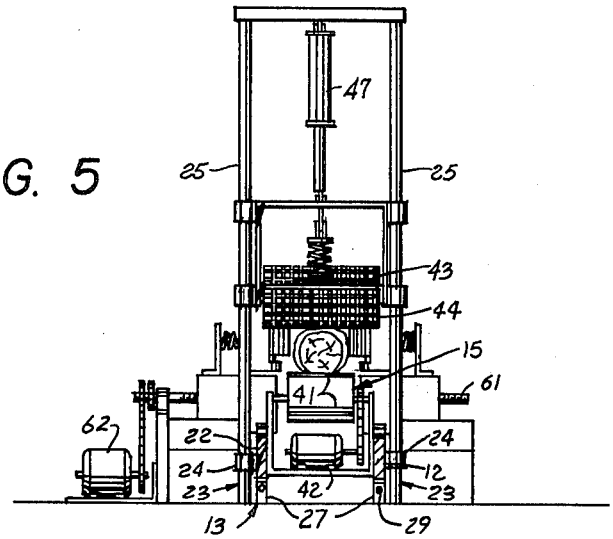

LOG FEED MECHANISM FOR SAWMILLS

BACKGROUND OF THE INVENTION

The present invention is related broadly to the field of feed mechanisms for automatically feeding successive logs into a sawmill in which the logs are cut into cants and, subsequently, into lumber.

There has been much advantage realized lately in the lumber industry in the provision of "one pass" lumber forming operations in which a series of chipping heads are provided in combination with one or more saws to cut and chip successive logs in a single pass into prescribed size lumber and marketable wood chips. The problem associated with sawing and chipping systems is in the proper holding and feed of successive logs to the mechanism. Logs are not always straight along their lengths nor uniformly round. Thus, the problem of holding successive logs along a prescribed path for efficient sawing thereof is a difficult problem to overcome. Unless the successive logs are held rigidly, they may turn or twist slightly as they move through the chipping and sawing stations. Such movement binds the saw blades. If this movement is slight, the result is that the lumber formed will have a longitudinal twist and will therefore be of inferior grade. If the twist is more violent, the bind upon the saw blades can be sufficient to damage the blades and cause a shutdown of the entire processing area until the blade is replaced or repaired.

U.S. Pat. No. 3,627,005 to Morton et al issued Dec. 14, 1971 discloses a machine for cutting peeler cores or logs into studs and chips. This machine is used to manufacture chips and lumber from logs. Logs are fed in a single pass through four chipper heads which reduce the log to a rectangular piece of lumber or "cant". Downstream of the chipper heads are saws that cut the cant into a number of smaller pieces. Logs slide on upright legs of an inverted U-shaped channel and are centered by an overhead centering drive wheel. The particular shape of the drive wheel is utilized to center the successive logs on the channel slide. The wheel is adjustable to accommodate different size logs. Other drive mechanisms are provided in the form of overhead spiked wheels. Output elevation of the successive logs is not adjustable nor are there specific provisions made for crooked logs or logs having swelled butts or other irregularities along their lengths.

U.S. Pat. Nos. 3,457,974 and 3,313,329 granted July 29, 1969 and Apr. 11, 1967 respectively to L. A. Mitten disclose method and apparatus for production of stud lumber from logs of small diameter. This method and apparatus works primarily on logs from five to eight inches in diameter. It includes chippers that take a flat cut and also form two longitudinal grooves on opposite sides of the flats. Overhead "V-grooved" rolls are located on a press to center successive logs and hold them as they move through the machine. One chipping head is movable to enable production of a finished four sided cant of either four by four or four by six inches in cross sectional dimension.

U.S. Pat. No. 3,344,826 to L. A. Mitten granted on Oct. 3, 1967 discloses an apparatus for production of pulp chips and stud lumber from peeler cores. This machine is to be utilized again on small diameter logs (five and one half to six inches in diameter). Two cutter or chipper heads are shaped to form on half of the cross sectional shape of the finished cant. Two overhead "V" rolls center each log on a chain conveyor and lead it into the chipping heads.

U.S. Pat. No. 3,934,630 granted on Jan. 27, 1976 to R. R. Cockle discloses a method and apparatus for producing rough cut lumber. This apparatus is also used strictly on small diameter logs. The unit is portable for use in situ. Four chipper heads form successive logs into four sided cants and a two bladed circular saw then cuts the cant into three boards. Each log is held steady by longitudinal guide splines that are received in grooves that have been cut in the log ahead of the chipper heads. The successive logs are centered prior to the groove forming operation by spring loaded bars and rubber tires.

The present feed mechanism is distinguishable from the above cited prior patents. It includes a "rosser" that forms a smooth surface along a bottom side of each log as it moves through the feed mechanism. This smooth surface is firmly gripped by longitudinal working flight of a spiked chain conveyor. Thus, along with downward press rolls, the successive logs are held firmly against lateral twist. Also, the successive logs are held against undesirable lateral movement by adjustable side rolls. These rolls are located on opposite sides of the working flight and are spring biased to press inwardly at diametrically opposed contact points along the log as it moves from the feed mechanism. Another important distinguishing feature to note is that the present feed mechanism is vertically adjustable. The feed rolls and rosser along with the longitudinal conveyor are mounted to a vertically movable framework. This frame may be selectively adjusted up or down to determine the elevational position of the logs as they move toward the chipper and/or sawing stations of the associated mill. Thus, the feed will determine the depth of cut made by the bottom horizontal chipper or saw. This adjustment is functional in determining the most efficient cuts to make in relation to the diameter of the log being fed to the forming apparatus.

SUMMARY OF THE INVENTION

A log feed mechanism is described that is adapted to be installed in line with a lumber sawing system. It is comprised of a vertically elongated movable framework with lift means for selectively vertically moving to movable framework. A first conveying means is located on the movable framework for horizontally orienting successive logs of varying diameter such that their axes will all lay within a vertical plane and for moving the centered logs in a forward direction. Rolling means is associated with the first conveying means for lifting a selected log from the first conveying means and rotating the log about its longitudinal axis to a selected position. It may subsequently be operated to place the log back on the second conveying means in the selected position. The rosser means is also positioned on the movable framework in the path of successive logs on the first conveying means. It forms a smooth surface along the length of successive logs as they pass by. Press roll means is upwardly adjacent the rosser means to press downwardly against successive logs moving along the first conveyor means past the rosser means. A second conveyor means is located on the movable framework downstream of the rosser to receive successive logs from the first conveyor and rosser. It includes an elongated working flight for engaging successive logs along the smooth surfaces formed by the rosser. Side roll means is provided adjacent to and on opposite sides of the second conveyor means. The side roll means operate to press against opposite lateral sides of the successive logs to hold the logs with their axes along said vertical plane.

A first object of the present invention is to provide a feed mechanism for logs being fed to sawmill operations by which the successive logs may be securely held with their center axes oriented in a vertical plane regardless of the effective diameter of the logs.

A further object is to provide such a feed mechanism that functions to securely hold successive logs fed therefrom against movement out of a path selected by the feed means.

A still further object is to provide such a feed mechanism that may be installed in existing sawmill facilities without necessitating substantial modifications on existing milling equipment.

A still further object is to provide such a feed mechanism that enables an operator to select the optimum position of successive logs prior to the cutting operation such that the optimum value of lumber may be produced from each log.

A still further object is to provide such a mechanism that is sturdily and simply constructed and therefore relatively maintenance free.

These and still further objects and advantages will become apparent upon reading the following detailed description, which, taken with the accompanying drawings, disclose a preferred form of my invention. However, it is to be noted that the following description and drawings are given only by way of example to set forth a preferred form of my invention. Other forms thereof may also be envisioned that are not specifically set forth. Therefore, only the claims found at the end of this specification are to be taken as definitions restricting the scope of what I claim to be my invention.

BRIEF DESCRIPTION OF THE DRAWINGS

FIG. 3 is a view taken along line 3—3 in FIG. 2

FIG. 4 is an end view as seen from the right in FIG. 2;

FIG. 5 is a sectioned view taken along line 5—5 in FIG. 2;

DETAILED DESCRIPTION OF A PREFERRED EMBODIMENT

Figure 1:
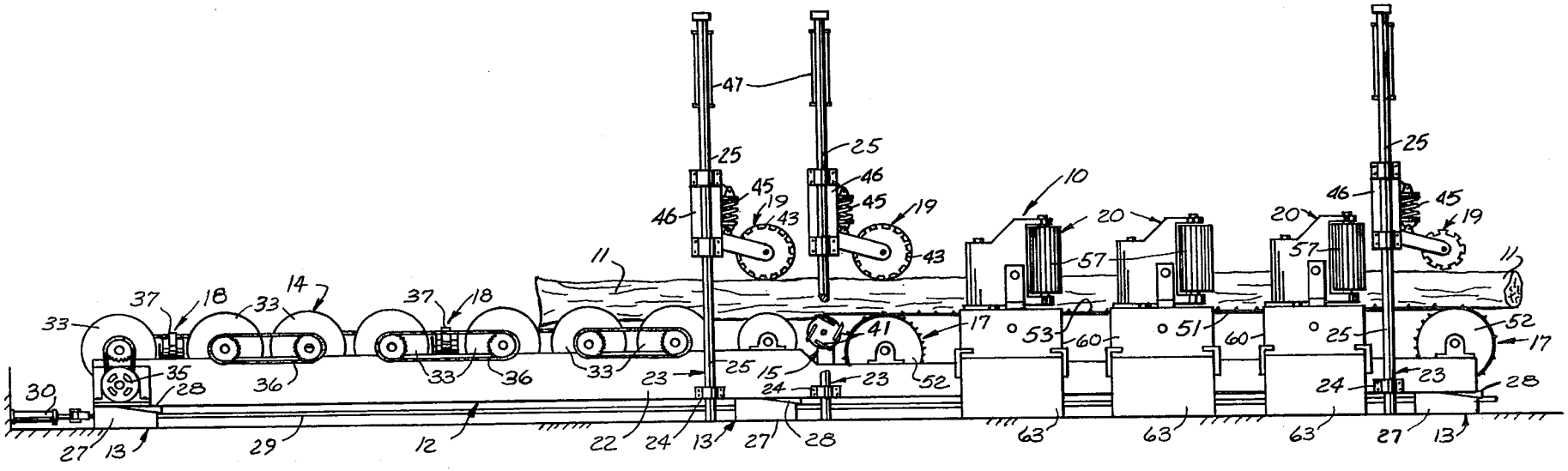
FIG. 1 is an overall plan view of the present feed mechanism.
Figure 2:
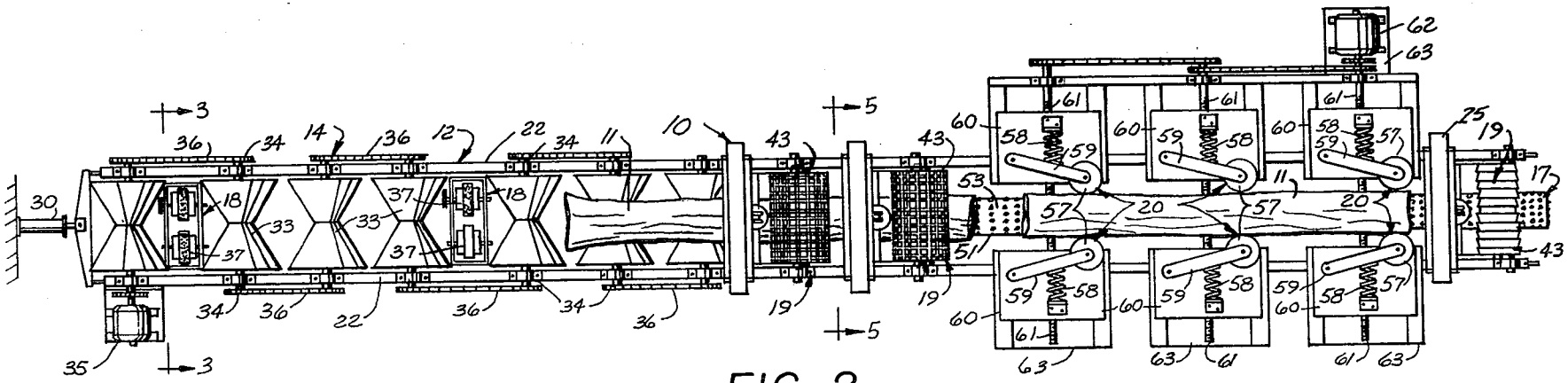
FIG. 2 is a side elevational view of the mechanism.

A preferred form of the present feed mechanism is illustrated in the accompanying drawings and is generally designated therein by the reference character 10. The present feed mechanism 10 is intended to operate upon successive cut logs, such as generally illustrated at 11, to feed the logs into the machinery of a sawmill (not shown).

The present mechanism is adapted to be installed in line with modern "single pass" sawing apparatus that are capable of cutting successive logs into standard size lumber and marketable wood chips during a single pass. Such machinery eliminates machinery otherwise needed to transfer cants to different work stations, and additional machinery by which the standard size lumber is eventually cut from the successive logs. The successive logs fed through the present mechanism 10 should pass directly to the saw, or chipper heads of the existing mill. It made no substantial difference with the present machine whether the saws or chipper heads are located to trim off vertical sides of the log as a first operation and subsequently chip away the bottom and top sides of the log to form a rectangular cant, or to place the top and bottom chipping heads upstream of the side forming heads. The present mechanism will operate as effectively with either form.

The present feed mechanism may be seen including a frame 12 that is vertically movable. The frame is movable through a lift means 13 to enable selective adjustment of the input height of successive logs to the machining processes downstream thereof. A first conveyor means 14 is located on the movable frame 12 to receive successive logs and move them in a predetermined path through the mechanism. The first conveyor means 14 is also utilized to center the successive logs regardless of diameter such that their longitudinal center lines are all substantially aligned within a vertical plane.

The first conveyor means 14 is powered to move the successive logs longitudinally past a rosser means generally indicated at 15. The rosser means is utilized to form a smooth, even surface along the length of each successive log. This surface is to be subsequently engaged by a second longitudinal conveyor means 17. The conveyor means 17 firmly grips each log along the smooth surface created by the rosser means 15. It moves successive logs downstream while maintaining the secure grip so the logs may be fed directly into the associated milling machinery with little chance for the logs to twist laterally or longitudinally as they progress through the machinery.

Also provided with the present mechanism 10 is a transverse roller means 18. The roller means 18 is selectively utilized to lift logs upwardly from engagement with the first conveyor means 14 and to set the lateral attitude of the log by rotating it about its longitudinal axis. An operator may control operation of means 18 to select the most appropriate position of the log to enable the most efficient cutting operations to be performed. Once this position has been selected, the roller means may be operated to lower the log again onto the first conveyor means where it will remain in that selected position as it moves past the rosser means 15 and onto the second conveyor means 17.

The successive logs are held against the surfaces of the first and second conveyor means by a press roll means 19 and side press roll means 20. The press roll means 19 is situated to exert downward pressure on logs passing by. It is operative to press the successive logs against the first conveyor means 14 and the rosser means 15 to assure that a smooth continuous surface is formed as the logs are passed over the blades of the rosser means. Means 19 is also useful in holding the trailing ends of successive logs on the second conveyor means 17 at the discharge end thereof.

The side press roll means 20 is located adjacent to the second conveyor means 17. Means 20 includes a number of upright press rolls that laterally press against each log as it moves from the rosser means onto the second conveyor means 17. The side press roll means 20 cooperates with second conveyor means 17 to rigidly hold the successive logs and thereby provide a stable feed to the downstream milling operations.

Figure 6:
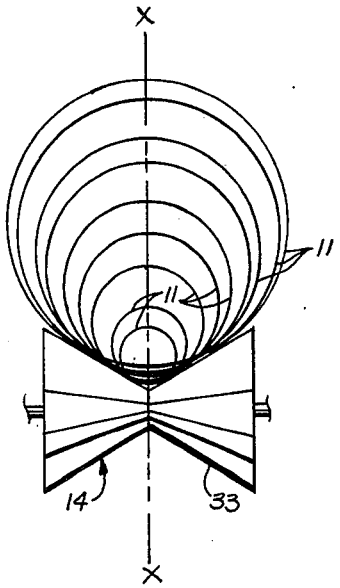
FIG. 6 is a diagrammatic view illustrating the range of log diameters acceptable to the present machine.
Figure 7:
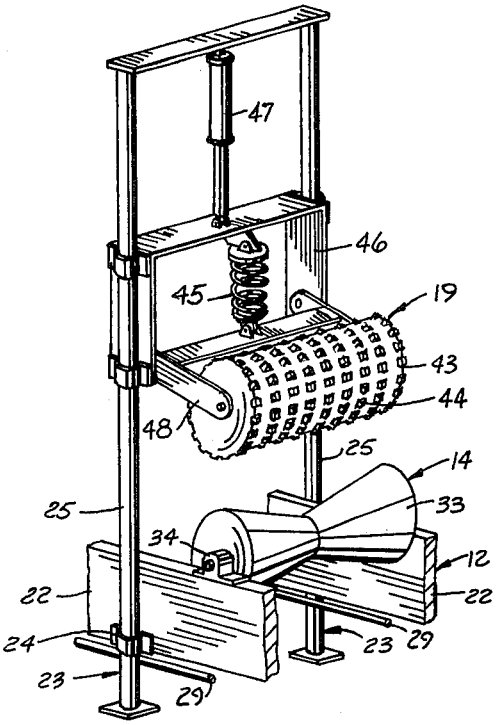
FIG. 7 is an enlarged fragmentary pictorial view of a portion of the present mechanism.

The above paragraphs have been provided as a general overview of my invention. What now follows is a more detailed description which will be easily understood in view of the above basic description. More specifically then, the framework 12 is elongated and comprised basically of a spaced pair of parallel longitudinal frame members 22. The frame members 22 are vertically movable as determined by a guide means shown at 23. Guide means 23 includes collars 24 rigidly fixed to the frame members 22. Collars 24 slide over upright stationary guide bars 25. The actual distance that the frame members 22 are required to move is in direct relation to the varying diameter of successive logs being fed through the mechanism 10 to the downstream milling operations. FIG. 6 diagrammatically presents the relative diameters of logs acceptable with the present feed mechanism.

The lift means 13 that moves the frame members 22 up and down is comprised of a number of movable wedge blocks 27 that operate against complementary blocks 28 (FIG. 1) fixed to the frame. Each wedge block 27 is connected to a rod that, in turn, is connected to a cylinder 30. The cylinder is double acting and functional to slide the wedge blocks 27 horizontally relative to the complementary fixed blocks 28. This arrangement is operable to vertically move the frame members as the inclined planes of the blocks slide on one another. It is conceivable that other mechanisms may be utilized to vertically move the frame members. For example, it may be utilized to vertically move the frame members. For example, it may be possible to provide a series of hydraulic jack cylinders, each substantially replacing the blocks 27 and 28. Another alternative is to utilize screw jacks for the same purpose.

There is a distinct advantage in providing the vertical adjustment facility of the present mechanism. If chipping heads are utilized in the downstream mill to form the initial cant, the vertical adjustment of the feed enables selection of the depth of cut for the lower horizontal chipping head. This creates an optimum sized cant without requiring vertical adjustment of the bottom horizontal chipping head and the remainder of the supporting mechanisms and machinery downstream thereof. Thus, all cants may be delivered from the mill machinery at a single elevation, while the elevation of the infeed for the successive logs is varied.

The first conveyor means 14 is comprised of a series of rollers 33. Each roller 33 has an axial hyperboloid or "trough" shape in order to center successive logs along the desired path of travel regardless of the cross sectional diameter. FIG. 6 illustrates diagrammatically the range of acceptable log sizes that may be efficiently operated upon by the present feed mechanism. It may be noted that the rollers 33 will automatically center the logs in their trough configurations such that the center lines of the successive logs are all aligned within a single vertical plane. This plane is indicated in FIG. 6 by the reference line X—X. Thus, each log will be fed into the lumber milling apparatus in a prescribed position along the vertical plane X—X. The feed mechanism may thus be positioned with respect to the milling mechanisms to precisely locate this plane in relation to the cutting elements, so they may produce an optimum amount of lumber and minimal amount of chips from each log.

Each roller 33 is mounted to the movable framework 12 by a pair of bearings 34. These bearings locate the rotational axes for the rollers in perpendicular relation to the plane X—X and to the direction of travel for the successive logs. A drive motor 35 is provided and is interconnected with the rollers 33 by a succession of chains 36. Thus, all the rollers 33 are driven to rotate and therefore pull the successive logs toward the rosser and second conveyor.

The log roller means 18 is situated among the conveyor rollers 33 of the first conveying means 14. It is comprised of two spaced pairs of rollers as shown at 37. However, these rollers 37 are located on rotational axes that are parallel to the center lines of the successive logs. The rollers 37 are in pairs with each pair mounted to a vertically movable carriage 38. A cylinder 39 is provided between each movable carriage 38 (FIG. 3) and the supporting floor surface. Cylinders 39 are operable to lift the carriages and attached rollers 37 upwardly to engage and lift a selected log from engagement with the first conveyor means 14.

The rollers 37 are spaced equidistant from the transverse center or apex of the rollers 33 so they will retain each log in its centered position as it is lifted from the first conveyor means. A roller drive 40 is provided on each carriage 38. It is connected to one of the rollers 37 (which is spiked) on the carriage to facilitate rotational movement of the log engaged thereby about its center axis. Thus, an operator may selectively position each successive log so defects such as cracks may be placed in a vertical position (if the downstream saws operate to make vertical cuts) in order that the most efficient use may be made of the log. Otherwise, logs would pass at random into the milling machinery and lumber of undeterminable grade would result. The cylinders 39 may be operated, after a log has been selectively positioned, to lower the log while in the selected position onto the first conveyor means 14. The log will remain in this position as it moves along the path toward the adjacent milling machinery.

The positioned and centered logs are fed across the rotating blades of the rosser means 15. Basically, the rosser means 15 is comprised of a number of rosser blades 41 that are driven to rotate by a rosser drive 42 (FIG. 5). The rosser is provided to remove knots, swelled butts and other irregularities from the bottom surface of each log passing by. The rosser blades 41 form a smooth, relatively flat surface along the bottom surface of each log. The rosser operates upon the full length of each log in order to provide smooth, relatively flat gripping surfaces for the second conveyor means 17. The rosser blades are rotatably mounted to the framework 12 and will move vertically with the framework in response to the operation of the lift means 13.

The press roll means 19 is provided adjacent to rosser means 15 in order to assure positive engagement of the rosser means and logs as they pass by, and adjacent the discharge of second conveyor means 17 to assure a firm grip on successive logs until they completely leave engagement with the feed mechanism. The press roll means 19 is comprised of a number of press rolls 43. One roll 43 is located upstream of the rosser means while another is downstream therefrom. The remaining roll 43 is located at the discharge of the feed mechanism. The press rolls 43 include fluted and grooved surfaces 44, denoted by axial grooves and intersecting annular grooves that are biased downwardly against the upper surfaces of successive logs. They also serve to prevent the logs from rotating about their center axes.

Each press roll 43 is biased downwardly by a spring 45 that extends between a pivoted lever arm 48 carrying the press roll and a movable carriage 46. A cylinder 47 is attached to the movable carriage 46 at one end and is connected at an opposite end to a framework built on the stationary guide bars 25. Each cylinder 47 is double acting and may function to raise or lower the attached press roll 43 vertically relative to the rotational axis of the rosser blades 41. This adjustment feature facilitates positioning of the press rolls 43 with regard to the cross sectional diameter of successive logs passing along the mechanism. The springs 45 are provided to continuously urge the rollers against the surface of successive logs and to maintain the associated roller 43 in contact with the log surfaces.

It is intended that the present feed mechanism be operated at comparatively high rates of speed (equivalent to the upper limits of capability for the associated milling machinery). Thus it is necessary that the rollers 43 be sufficiently resilient to stay in contact with the moving surfaces, whether irregular or smooth, of each log passing by so they may effectively press the logs downwardly into engagement with the rosser means 15. The springs 45 accomplish this function while the cylinders 47 provide the desired adjustability for logs of different diameter.

The second conveyor means 17 is located directly downstream of the rosser means 15 for immediately receiving successive logs therefrom. Second conveyor means 17 includes an endless chain 51 that is wrapped about longitudinally spaced sprockets 52. The sprockets 52 hold the chain 51 to define an upward horizontal working flight 53 that is set elevationally at the working depth of cut for the rosser means 15. Successive logs will be immediately received by the working flight 53 without any change in elevational position of the logs as they proceed from the rosser means to the conveyor chain 51. Chain 51 includes a lateral width dimension that is substantially the same as the complementary dimension of cut surface on successive logs produced by the rosser means. Therefore, the entire working flight 53 will engage the successive logs across the full width of the rosser cut and along a considerable part of the length thereof. Spikes are included on the chain 51 to protrude outwardly and become imbedded within the successive logs along the surface formed by rosser means 15. Thus, an extremely firm grip is maintained between the second conveyor means 17 and the logs engaged thereby.

The length of chain 51 may vary according to the intended usage of the feed means in relation to the associated milling machinery. For example, the design could be such that the chain 51 would extend between adjacent vertical side chippers (of the milling machinery). In any case, the length of the second conveyor means 17 is such that its discharge may be located just slightly upstream of the horizontal chipping tools or saws of the associated milling apparatus.

I have provided the side press roll means 20 to further assist the second conveyor means 17 in holding the logs securely for operation by the downstream milling apparatus. More specifically, the side press roll means 20 is comprised of a plurality of fluted rollers 57 that are located on direct opposite sides of the second conveyor means 17. The fluted rollers 57 are biased, like rollers 43, such that they will engage direct opposite sides of the successive logs as they pass by. Biasing springs 58 are provided to interconnect each roller and pivoted mounting bracket 59 to a lateral slide adjustable carriage 60. A series of lateral jackscrews 61 are connected between the carriages 60. The jackscrews are rotated in unison by a drive motor assembly 62 on a stationary framework 63. The motor assembly 62 may be selectively operated to facilitate lateral adjustment of the rollers 57 in response to varying diameters of successive logs moving along the aligned conveyors 14 and 17. Jackscrews 61 have both right and left hand threads to effect the roller adjustment.

From the above description, operation of the present mechanism may be easily understood. To initiate operation, a log is fed onto the first conveyor means 14. This is done either by moving the log transversely from a laterally located storage bin onto the rollers 33 or by moving successive logs longitudinally from a source adjacent the end of the feed mechanism. The present mechanism will function equally as well under either condition. It may be located within a mill having either form of initial log infeed apparatus.

Successive logs are received on the first conveyor means 14 and are automatically centered along the prescribed vertical plane XX through provision of the hyperboloid shaped conveyor rollers 33. This function is diagrammatically illustrated in FIG. 6.

An operator may be stationed adjacent the first conveyor means 14 in a position to afford him a clear view of the butt ends of successive logs loaded onto the first conveyor means. If he detects a crack or other defects that would affect the efficient milling of a log into lumber, he may accordingly operate the roller means 18 to rotate the log to a desirable position. In operation, the cylinders 39 lift the log in question upwardly from engagement by the first conveyor means 14. The log is then supported only by the longitudinal rollers 37.

The selectively rotated rollers 37 also impart rotational motion to the log held thereby. Thus, the operator may selectively set the attitude of the log about its axis such that the defect will appear in a minimum number of resulting boards. Through this operation, an optimum amount of usable high grade lumber may be taken from each log.

After the log is rotated to the selected position, the operator may actuate the cylinders 39 to lower the log back onto the first conveyor means 14. The log will remain centered and in the set attitude while it is carried through the mechanism. This is so because the log has been previously centered on the rollers 33 and the centered position is maintained by rollers 37 while the log is disengaged from the first conveyor means 14. Thus, the log will not move (roll) again as it is lowered onto the first conveyor means for the second time.

First conveyor means 14 function to move successive logs along toward the rosser means 15. The rosser means 15 is operated continuously to take a relatively shallow cut through each successive log in order to remove irregular surfaces and to present a smooth flat surface for engagement by the second conveyor means 17. The press rolls 43 function to hold the log downwardly against the rosser means as it is passed by.

The logs move continuously from the first conveying means 14 to the rosser means 15 and subsequently to the second conveyor means 17. The working flight 52 of the second conveyor means 17 functions to securely engage the surface previously prepared by the rosser means 15, firmly holding the log against lateral movement as it is fed from the feed mechanism 10 into the associated milling machinery. The fluted rollers also contribute to the function of second conveyor means 17 to hold the successive logs firmly on center and against twisting forces while moving them into the lumber forming machinery.

The lift means 13 may also be controlled by the operator or may be controlled through automatic sensing devices that are presently known in machinery controls for automated sawmills. Therefore, whatever the input, be it visual on the part of the operator or sensed on the part of some control mechanisms, the lift means 13 may be operated to raise or lower the functional elevation of the feed mechanism such that the discharge elevation of the logs may be selectively varied. By providing this function at the input point for the lumber forming machinery, it does not become necessary to provide adjustment features for the milling apparatus by which a horizontal cant forming cut is made along the bottoms of successive logs. This depth of cut may be varied by changing the input elevation of the log while holding the cutting device at a fixed elevation. Therefore, if a relatively deep cut is desired, the framework will be lowered accordingly. If a shallow cut is desired, the framework will be accordingly elevated. The criterion for the elevational determination is the effective cross sectional diameter of the log to be fed into the machinery and the actual physical condition of the log. For example, a log that is substantially bent along its length may require a relatively deep cut by the lower cutting assembly (usually a chipper) in order that a smooth even surface be formed along the entire length of the cant. Therefore, the feed mechanism will be accordingly lowered to a point where the relatively stationary cutting tool may form a flat smooth surface along the entire length of the log.

Known automatic controls may be provided automatically set the side rolls 57 and press rolls 43 at positions corresponding to the diameters of successive logs. This could be accomplished by known forms of sensors determining the diameter of each log and actuating the cylinders 61 and 47 to move the rollers together or apart, assuring contact with each log along the full length thereof. Of course, such control could also be delegated to the machine operator, or the operator could be provided with override controls to augment the function of the sensor controls.

It may have become obvious from the above description and attached drawings that various changes and modifications may be made therein. In fact, other modifications are presently envisioned that are not disclosed within the specifications for the purpose of brevity. It should therefore be understood that only the following claims are to be taken as placing limitations upon the scope of my invention.

What I claim is:

1. A log feed mechanism adapted to be installed in line with a one pass chipping and sawing system, comprising:

an elongated vertically movable framework;

lift means for selectively vertically moving the movable framework;

first conveying means on the movable framework for horizontally orienting successive logs of varying diameter such that their axes all lie within a vertical plane and for moving the centered logs in a forward direction;

log rolling means associated with the first conveying means for lifting a log from the first conveying means and selectively rotating the log about its longitudinal axis to a selected position and subsequently placing the log back on a second conveying means in the selected position;

rosser means on the movable framework in the path of successive logs on the first conveying means for forming a smooth surface along the length of successive logs as they pass by;

press roll means upwardly adjacent the rosser means for pressing downwardly against successive logs moving along the first conveyor means;

second conveyor means on the movable framework downstream of the rosser and having an elongated working flight for engaging successive logs along the smooth surfaces formed by the rosser; and side roll means adjacent to and on opposite sides of the second conveyor means for pressing against opposite sides of the successive logs to hold the logs with axes along said vertical plane.

2. The feed mechanism as set out by claim 1 wherein the first conveying means is comprised of a series of generally hyperboloid shaped rollers mounted to the movable framework for rotation about axes normal to the intended path of logs on the feed mechanism.

3. The feed mechanism as set out by claim 1 further comprising press roll mounting means on the movable framework for vertically adjusting the press roll means in relation to the rosser means.

4. The feed mechanism as set out by claim 1 further comprising side roll mounting means for laterally adjusting the side roll means in relation to the diameters of successive logs moving along the second conveyor means.

5. The feed mechanism as set out by claim 1 wherein the lift means is comprised of horizontal wedge blocks slidably engaging complementary blocks on the movable frame and means for moving the wedge blocks horizontally relative to the complementary blocks and thereby lifting the complementary blocks and movable framework vertically.

6. The feed mechanism as set out by claim 1 wherein the second conveying means is comprised of an elongated endless chain having outwardly projecting spikes that grip successive logs along the smooth surface formed by the rosser.

7. The feed mechanism as set out by claim 1 wherein the side roll means is vertically stationary relative to the movable framework.

8. The feed mechanism as set out by claim 1 wherein the side roll means is comprised of at least two upright rollers mounted on opposite sides of the second conveyor means and further includes biasing means for urging the rollers toward each other against successive logs moving on the second conveyor means.

9. The feed mechanism as set out by claim 1 wherein the press roll means includes a number of longitudinally spaced rollers located on opposite longitudinal sides of the rosser means with spring means associated therewith for pressing the rolls downwardly against successive logs moving along the first and second conveying means.

10. The feed mechanism as set out by claim 9 wherein the rollers are annularly fluted and axially grooved.

11. The feed mechanism as set out by claim 1 further comprising guide means for allowing only vertical movement of the movable framework adjustably connecting the movable framework with the floor support surface.

* * * * *